United States Patent [19]

Violet et al.

[11] 4,223,997

[45] Sep. 23, 1980

[54] PORTABLE CEMENT MIXER

[75] Inventors: Jon A. Violet, Fredericktown, Ohio; Hans Hauser, Bradenton, Fla.

[73] Assignee: The J. B. Foote Foundry Co., Fredericktown, Ohio

[21] Appl. No.: 12,586

[22] Filed: Feb. 16, 1979

[51] Int. Cl.[2] ..... B28C 5/20

[52] U.S. Cl. ..... 366/47; 366/60; 366/185

[58] Field of Search ..... 366/45, 47, 48, 62, 366/63, 60, 56, 57, 185, 189

[56] References Cited

U.S. PATENT DOCUMENTS

| | | | |
|---|---|---|---|
| 2,703,703 | 3/1955 | Nargelovic | 366/60 |
| 2,981,524 | 4/1961 | Yager | 366/48 |
| 3,173,665 | 3/1965 | Hall | 366/47 |
| 4,042,222 | 8/1977 | Clement | 366/47 |

*Primary Examiner*—Robert W. Jenkins
*Attorney, Agent, or Firm*—Allen D. Gutchess, Jr.

[57] ABSTRACT

A mixer particularly designed for light, domestic use is provided. The mixer includes a base frame, a mixing drum, and a handle, all of which are readily assembled and disassembled for easy transportation, even in an automobile. The drum is supported on the base frame with a three-point suspension, including an axle rotatably carried by the base frame and two rollers on the base frame which engage the drum in a position spaced from the axle toward a discharge opening of the drum. The drum is of one-piece construction and has a ring gear formed of integral, circumjacent teeth, with the axis of rotation of the drum and the gear being at an angle to the horizontal. An electric motor is mounted on the base frame directly below the drum and has a drive shaft parallel to the axis of rotation of the drum and gear with a pinion gear engagable with the integral, circumjacent drum teeth. The drum can be readily lifted off the base frame and the handle also can separated therefrom. Further, the base frame is designed with curved frame members which enable the entire mixer to be tilted to discharge the contents of the drum.

6 Claims, 13 Drawing Figures

PORTABLE CEMENT MIXER

This invention relates to a mixer and particularly to a cement mixer for light, domestic use.

While the mixer is usually employed for mixing cement, it can also be used for other domestic applications, such as mixing soil or dirt for gardening.

The mixer incorporates several unique features. The mixer includes a base frame upon which a mixing drum is rotatably mounted so that the removal of one pin can enable the drum to be separated from the base frame. The drum is mounted on the base frame with a three-point suspension, including an axle located on the axis of rotation of the drum and rotatably held by the base frame with the aforesaid pin. The base frame also has two rollers which engage the drum on a circular line lying in a plane perpendicular to the axis of rotation, at a location spaced from the axle toward the charge and discharge opening of the drum. The handle can also be readily removed from the base frame for easier transportation and storage.

The drum of the mixer is of one piece, plastic construction except for an axle affixed thereto and mixing paddles mounted therein. The mixer even has a ring gear with structurally-integral teeth by means of which the drum is driven and rotated.

The mixing drum is driven by a pinion gear and an electric motor located directly under the drum, with the drum being readily separable from the pinion gear simply by removing the drum from the base frame.

It is, therefore, a principal object of the invention to provide an improved mixer for cement and the like having the unique features and advantages discussed above.

Many other objects and advantages of the invention will be apparent from the following detailed description of a preferred embodiment thereof, reference being made to the accompanying drawings, in which.

Figure 1:
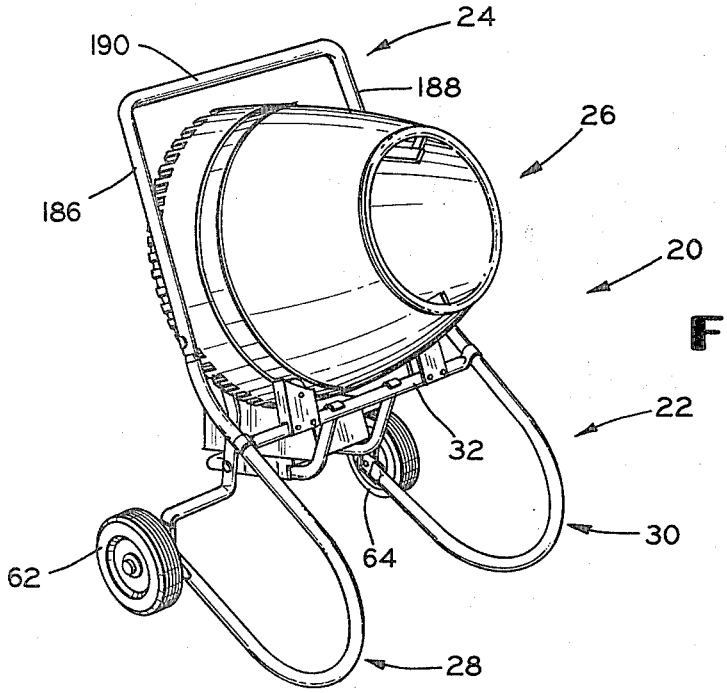
FIG. 1 is a view in perspective of a mixer in accordance with the invention.
Figure 2:
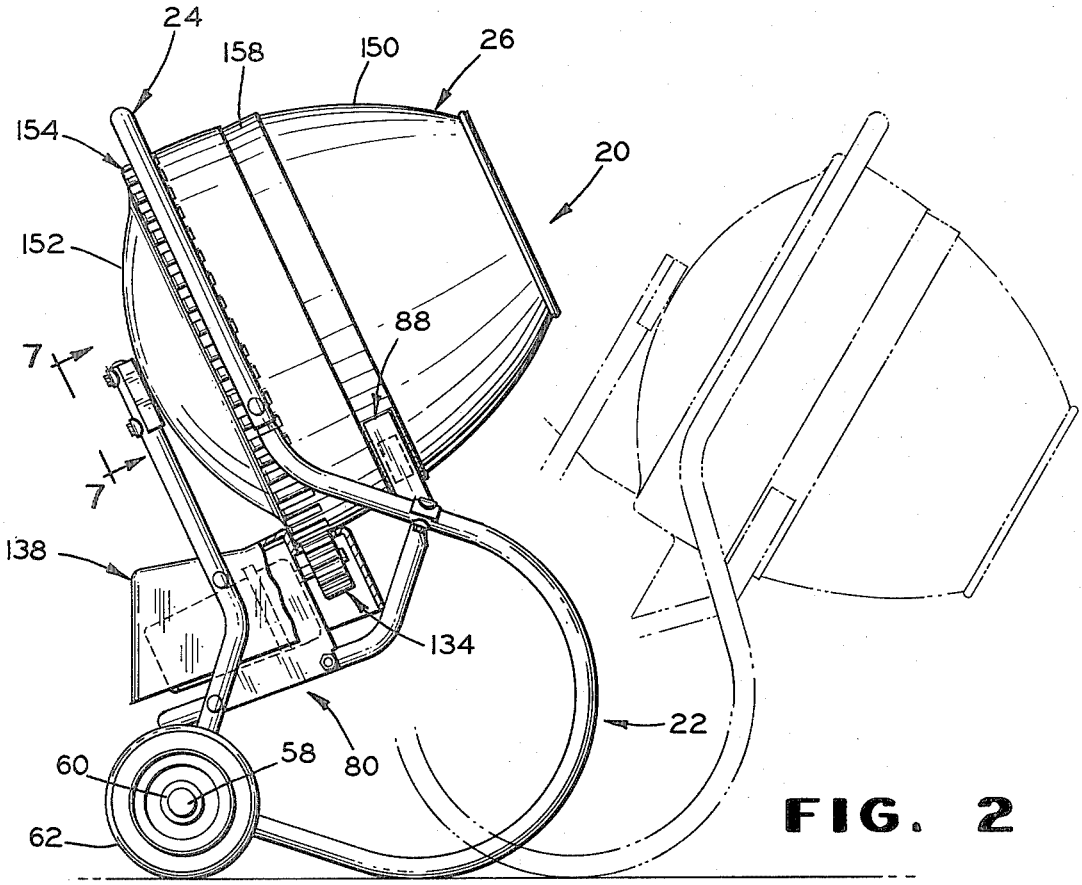
FIG. 2 is a somewhat enlarged side view in elevation of the new mixer and showing a tilted position thereof in dotted lines.
Figure 13:
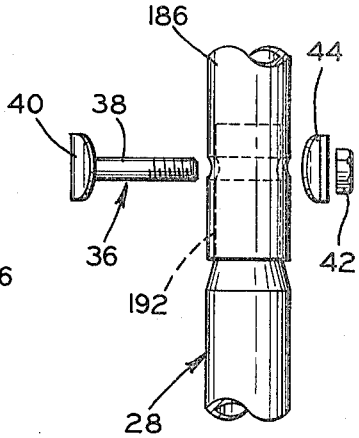
FIG. 13 is an enlarged, fragmentary view of a joint between a handle and the base frame of the mixer.

A mixer in accordance with the invention is indicated at 20 and includes a base frame 22, a handle 24, and a mixing drum 26. The base frame 22, which is of tubular construction, includes two arcuate frame members 28 and 30 which enable the entire mixer 20 to be tilted to a dumping position, as shown in dotted lines in FIG. 2, for discharging the contents of the drum 26. Upper ends of the arcuate frame member 28 and 30 are held in spaced relationship by a transverse strut 32 having flattened and U-shaped ends 34 to fit closely with the outer surfaces of the arcuate frame members 28 and 30. The strut is affixed by bolts 36, as seen in FIG. 13, which have threaded shanks 38 and arcuate heads 40. The bolts are secured through nuts 42 and arcuate washers 44 having flat central portions which the nuts abut.

The lower, rear portions of the arcuate frame members 28 and 30 terminate in flattened ends 46 (FIG. 6) and are affixed by fasteners 48 to legs of V-shaped brackets 50. The brackets 50 have side flanges 52 and 54 cooperating with the edges of the flattened ends 46 of the frame members 28 and 30 to prevent pivotal movement of the frame members relative to the brackets. An intermediate portion 56 of each of the brackets 50 has an outwardly extending non-threaded stud or axle 58 (FIG. 2) and a push nut 60 to rotatably hold wheels 62 and 64 relative to the base frame 22.

Figure 4:
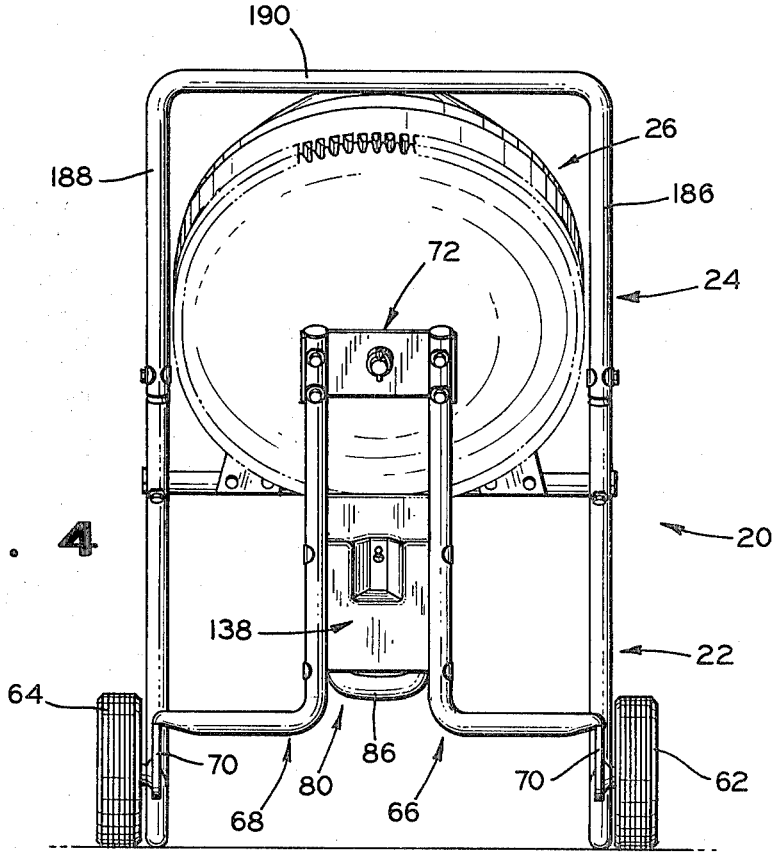
FIG. 4 is a rear view in elevation of the mixer.
Figure 6:
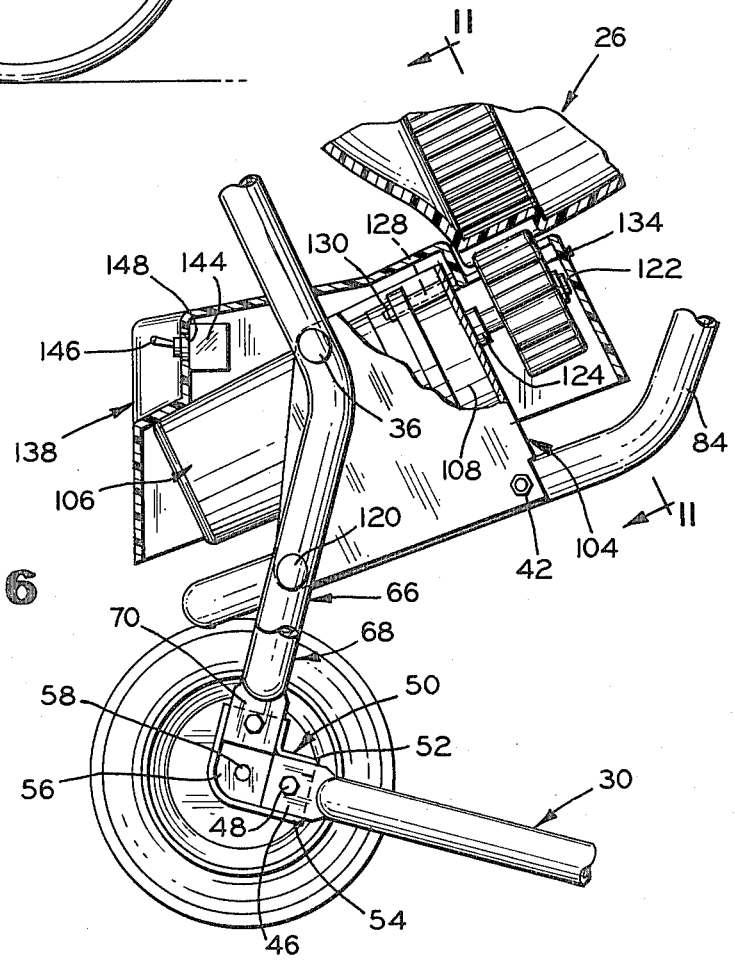
FIG. 6 is an enlarged, fragmentary view in side elevation, with parts broken away and with parts in section, of part of the base frame and drive unit of the mixer.
Figure 7:
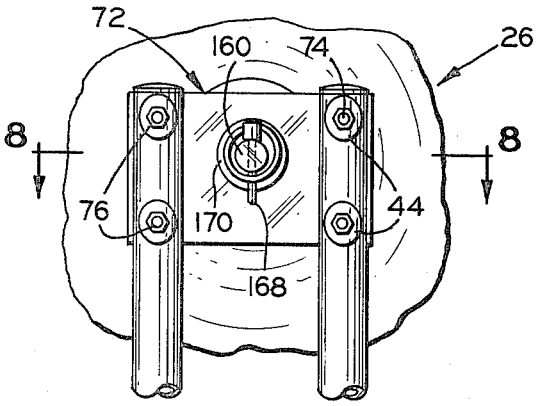
FIG. 7 is a rear view taken along the line 7—7 of FIG. 2 of a mixing drum axle and support on the base frame.
Figure 8:
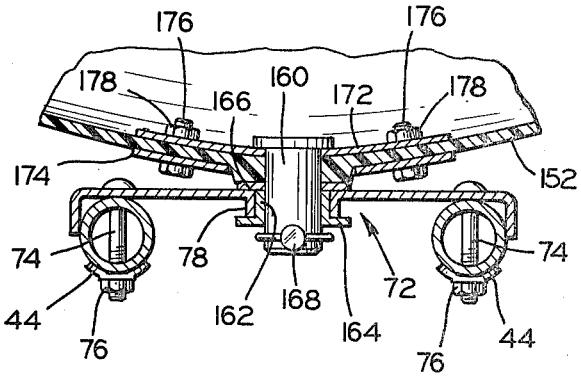
FIG. 8 is a view in horizontal section taken along the line 8—8 of FIG. 7 and further showing the drum axle and support.

Referring to FIGS. 4 and 6, two generally L-shaped frame members 66 and 68 have outer, lower flattened ends 70 received in the other legs of the V-shaped brackets 50. The upper ends of the L-shaped frame members are held in spaced relationship by a bearing plate 72 (FIGS. 4, 7, and 8) which is affixed to the upper ends of the frame members 66 and 68 by round head bolts 74, and nuts 76, and the arcuate washers 44. A bearing sleeve 78 is centrally located in the plate 72.

Lower portions of the generally L-shaped members 66 and 68 are also held in spaced relationship, in this instance, by a generally U-shaped frame member 80 (FIGS. 3 and 6), including legs 82 and 84 and a web 86. The lower portions of the legs 82 and 84 of this member are affixed to the L-shaped frame members 66 and 68 by the bolts 36 (FIG. 6) and the nuts and washers 42 and 44. Upper ends 86 (FIG. 3) of the legs 82 and 84 of the U-shaped member 80 are flattened and curved to be received on the transverse strut 32. The ends are affixed to the transverse strut 32 by suitable fasteners, such as the bolts 36 and the washers 42 and 44.

Figure 3:
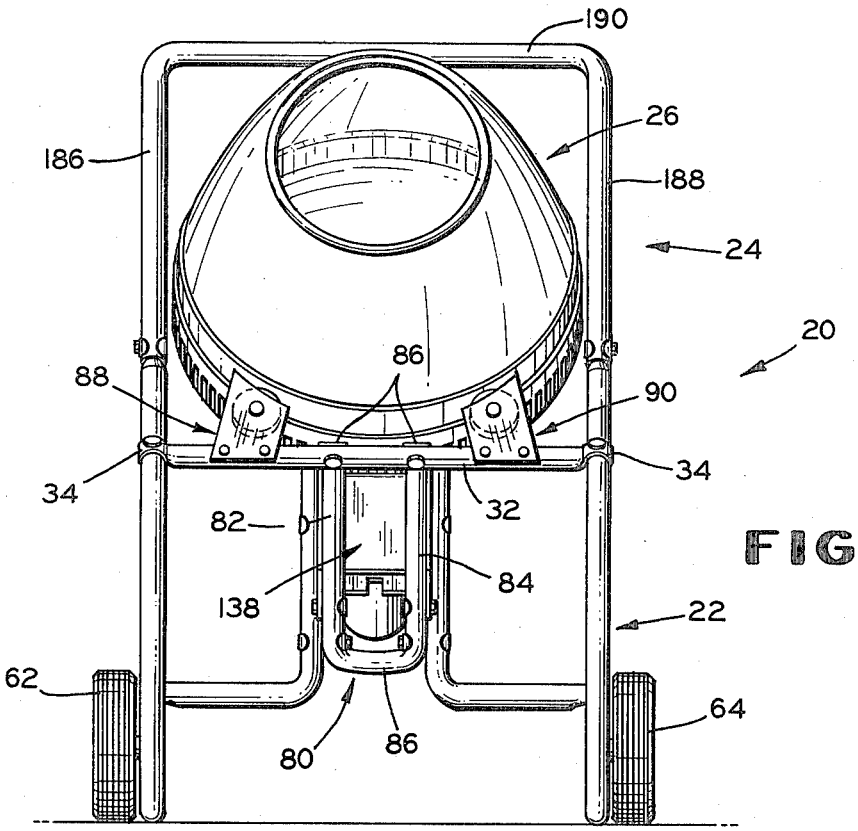
FIG. 3 is a front view in elevation of the mixer.
Figure 9:
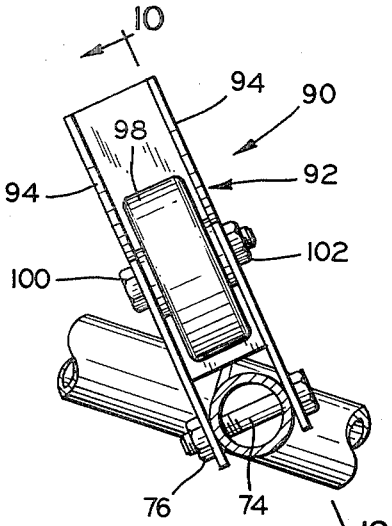
FIG. 9 is an end view of a drum-supporting roller assembly with a strut shown in cross section.
Figure 10:
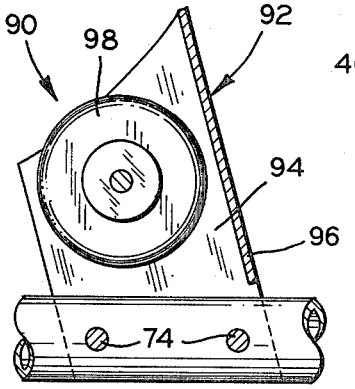
FIG. 10 is a view in section, taken along the line 10—10 of FIG. 9, of the drum-supporting roller assembly.

Referring to FIGS. 3, 9, and 10, roller assemblies 88 and 90 are also mounted on the transverse strut 32. The roller assemblies include generally U-shaped brackets 92 having lower edge portions affixed to the transverse strut 32 by suitable fasteners, such as the bolts 74 and the nuts 76. The brackets include side walls or legs 94 with curved upper edges and a connecting web 96. Rollers 98 are rotatably carried by the side walls 94 by shoulder bolts 100 and nuts 102, with the extremities of the rollers 98 projecting beyond the curved edges of the side walls 94.

Figure 11:
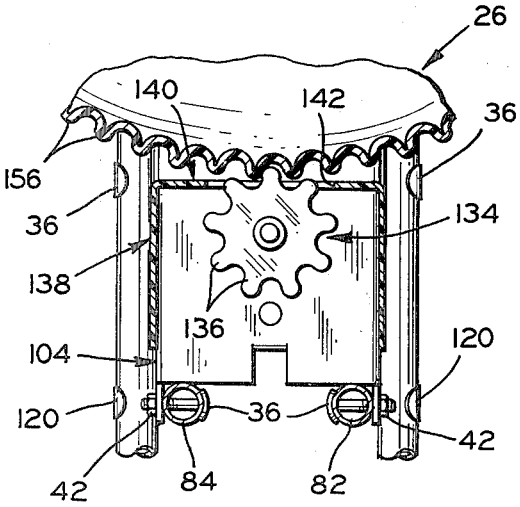
FIG. 11 is a view in transverse cross section taken along the line 11—11 of FIG. 6 of a portion of the base frame and drum drive.
Figure 12:
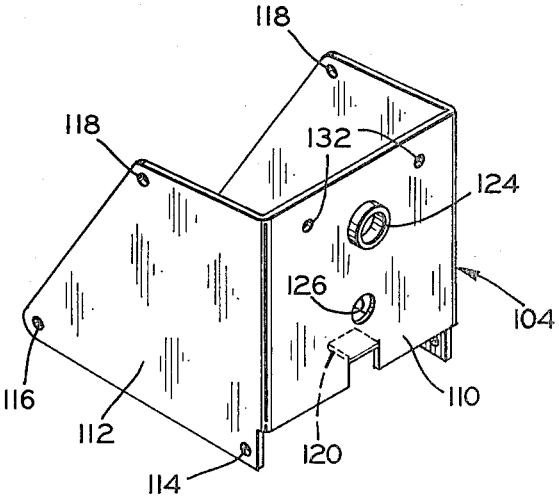
FIG. 12 is a view in perspective of a motor-supporting bracket.

Referring to FIGS. 6, 11, and 12, a motor mounting bracket 104 is used to position and support a drum driving motor 106 and a gear reducer 108 on the base frame 22 of the mixer 20. The mounting bracket 104 includes a main upright plate 110 with side walls 112 with fastener holes 114, 116, and 118. The side walls 112 are affixed to the legs 82 and 84 of the U-shaped member 80 by suitable fasteners, such as bolts and nuts 36 and 42 through the holes 114, and by similar but longer bolts 120 and nuts (not shown), through the holes 116. The bolts 36 and the nuts 42 can also be used with the holes 118.

The plate 110 has a lower tab 120 which abuts the front of the gear reducer 108. A drive shaft 122 extends through a bushing 124 in the plate 110 and an intermediate shaft (not shown) of the gear reducer 108 extends through a hole 126 and is held by a snap ring (not shown) which further aids in supporting the motor. Bolts 128 and nuts 130 also affix the motor 106 to the plate 110 through holes 132.

A plastic pinion gear or cog 134 is suitably mounted on the drive shaft 122 and has teeth 136 molded therein in a one-piece construction, the gear preferably being hollow.

A plastic motor cover 138 is positioned over the motor 106 and the mounting bracket 104 and can be suitably attached thereto. A front upper wall 140 of the cover has an opening 142 through which the teeth 136 of the gear 134 extend. A motor switch 144 is suitably mounted in a rear portion of the cover 138 above the motor 106. The switch has a handle 146 extending through an opening 148 in the cover. The sides of the cover 138 also have openings through which the bolts 36 for the bracket openings 118 also extend.

The mixing drum 26 is basically of a one-piece construction, having a truncated elliptical portion 150 and an integral, shallow, dish-shaped bottom portion 152. A circumjacent ring gear 154 having structurally integral teeth 156 (FIG. 11) is formed at the larger end of the elliptical portion 150 at the juncture with the bottom portion 152. The drum 26 is positioned so that the teeth 156 engage the teeth 136 of the pinion gear 134 but the drum is not supported by the pinion gear. Rather, the elliptical portion 150 of the drum has a generally cylindrical band 158 formed thereon which is engaged by the rollers 98 to support much of the weight of the drum.

Figure 5:
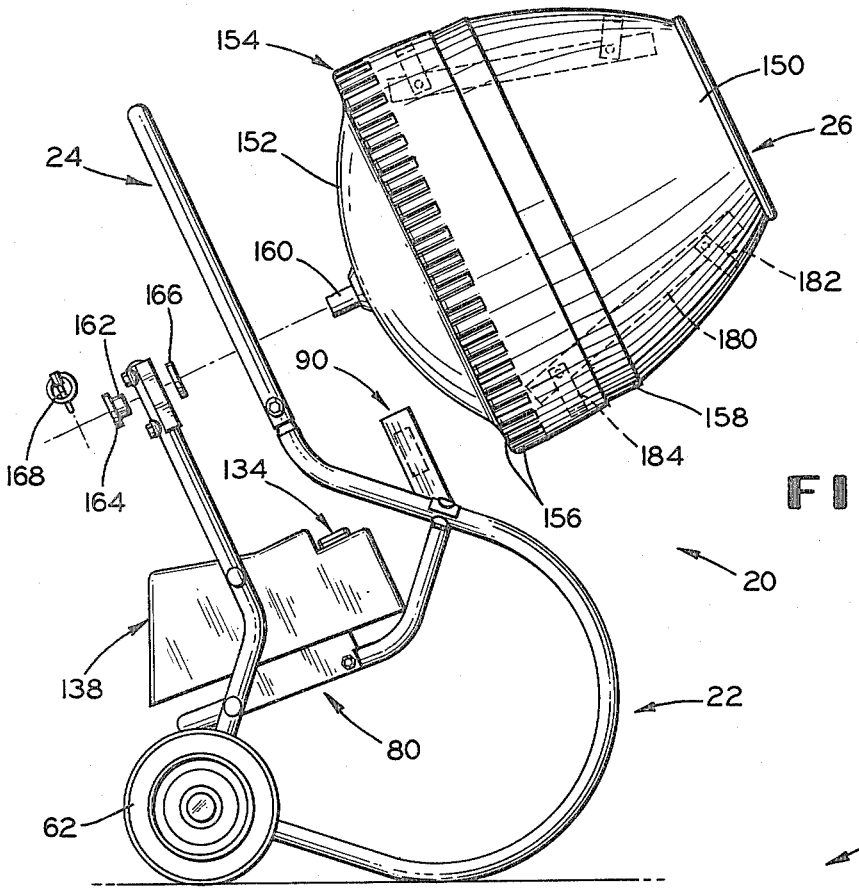
FIG. 5 is an exploded side view in elevation of the mixer, showing many of the parts in disassembled relationship.

In addition, the shallow bottom portion 152 has a stub axle 160 (FIGS. 7 and 8) extending therefrom, being coaxial with the axis of rotation of the drum. The axle extends through a flanged bushing 162 in the sleeve 78 having an outer flange 164 and through a washer 166 on the inner side of the bearing plate 72. The outer end of the axle 160 beyond the flange 164 has a transverse bore therein through which a pin 168 also (FIG. 8) extends. The pin is connected to a ring 170 which slips over the end of the axle 160 when the pin is inserted therein to hold the pin in position. The pin and ring are a commercially-available item, with the ring being mounted in an over-center condition in the pin so as to stay around the axle when moved to that position. The axle 160 is affixed to an inner reinforcing plate 172 which is connected to an outer reinforcing plate 174 by bolts and nuts 176, 178. Paddles 180 (FIG. 5) are located within the drum, being mounted on the interior surface by brackets 182, 184.

The handle 24 is of inverted, square U-shaped configuration with legs 186 and 188 and a wide web 190. The web spaces the legs sufficiently far apart that the drum 26 can be removed from the base frame without removing the handle. However, the handle can also be removed to further provide a compact volume for transportation or storage. Referring to FIG. 13, the upper ends of the frame members 28 and 30 are reduced in diameter at 192 so as to telescope within the lower ends of the handle legs 186 and 188. These have openings which are aligned when the members are in telescoping relationship to receive the bolt 36 to hold the handle on the base frame. If desired, wing nuts can be employed in place of the nuts 42 so that the handle can be removed without the use of tools.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. A mixer comprising a base frame having two spaced frame members with generally U-shaped portions positioned to engage a supporting surface, said base frame also having wheels and means maintaining said frame members in a spaced relationship, a mixing drum rotatably carried by said base frame and having an axle and a charge and discharge opening facing away from said wheels, whereby the mixer can be tilted on said U-shaped frame portions to discharge contents from said drum, said mixing drum having a circular cross section of varying diameter throughout at least most of its length, said drum having structurally-integral molded gear teeth forming a ring gear at a circular portion of said drum intermediate said opening and said axle, a motor mounted on said base frame, said motor having a drive shaft and a single drive gear mounted on said drive shaft, means mounting said drum on said base frame for rotation about an axis at an angle to the horizontal, said drive shaft being positioned to rotate on an axis parallel to said drum axis for all positions of said drum, with said drive gear being directly engagable with said ring gear, said drum mounting means comprising bearing means on said base frame rotatably carrying said axle, rollers on said base frame rotatably mounted thereon and engagable with said drum at a location spaced from said axle toward said drum opening, and quick release means engagable with said drum axle to prevent removal of said axle from said bearing means when said quick release means is engaged with said axle.

2. A mixer comprising a base frame having two spaced frame members with generally U-shaped portions positioned to engage a supporting surface, said base frame also having wheels and means maintaining said frame members in spaced relationship, a drum rotatably carried by said base frame and having an opening facing away from said wheels, whereby the mixer can be tilted on said U-shaped portions to discharge contents from said drum, said drum being made of one piece of plastic material, said drum having a circular cross section throughout most of its length, said drum also having structurally-integral molded gear teeth circumjacent thereof at a circular portion of said drum, said drum having a substantially uniform wall thickness in transverse cross section taken through said gear teeth, and means carried by said mixer for rotating said drum.

3. A mixer according to claim 2 characterized by said rotating means comprising a motor mounted on said base frame, said motor having a drive shaft and a single gear mounted on said drive shaft and directly engagable with said drum gear teeth, and said drive shaft being parallel to the axis of rotation of said drum.

4. A mixer comprising a base frame, an electric motor mounted on said base frame, said motor having a drive shaft and a single drive gear mounted on said drive shaft, a mixing drum rotatably carried by said base frame above said motor and having circumjacent gear teeth engagable directly with said drive gear, said drum being mounted for rotation about an axis at an angle to the horizontal, said drive shaft being positioned to rotate on an axis parallel to said drum axis, and a motor cover located around said motor and extending forwardly with an end wall beyond said drive gear and side walls on each side of said drive gear, said cover having an upper opening through which a portion of said drive gear extends to enable said drive gear to engage said circumjacent gear and still protect an operator from extending fingers between said drive gear and said circumjacent gear.

5. A mixer comprising a base frame having bearing means to receive an axle of a mixing drum, said frame also having two spaced rollers mounted thereon, a mixing drum having an opening and having an axle spaced from said opening, said axle extending through said bearing means, quick release means engagable with said axle to prevent removal of said axle from said bearing means when said quick release means is still engaged, said quick release means comprising a transverse bore in said axle on the side of said bearing means opposite said drum, a pin movably positioned in said bore, and means engagable with said pin and said axle to selectively enable said pin to be removed from said bore and prevent said pin from being removed from said bore.

6. A one-piece, plastic mixing drum for a mixer, said mixing drum having a circular cross section of varying diameter throughout at least most of its length, said drum having a charge and discharge opening at one end and having an axle at the end opposite the charge and discharge opening, said drum also having structurally-integral, molded gear teeth circumjacent thereof at a circular portion of said drum intermediate said opening and said axle, said drum having a substantially uniform wall thickness in transverse cross section taken through said gear teeth, said drum having a truncated elliptical portion and a shallow bottom portion, said gear teeth being located at the juncture of said truncated elliptical portion and said shallow bottom portion, said axle being affixed to a reinforcing plate within said drum and extending through the shallow bottom portion thereof, said drum having an additional reinforcing plate on the outer surface thereof through which said axle extends, and said truncated elliptical portion of said drum having a narrow cylindrical band therearound between said gear teeth and said opening, said drum forming an annular shoulder around said cylindrical band on the edge toward said gear teeth.

* * * * *